US005283723A

United States Patent [19]

Wu

[11] Patent Number: 5,283,723

[45] Date of Patent: Feb. 1, 1994

[54] BACKWARD PROJECTION TYPE WALL LAMP

[76] Inventor: Wen-Chon Wu, No. 4-1, Lane 324, An Kang Rd., Nei Hu, Taipei, Taiwan

[21] Appl. No.: 856,753

[22] Filed: Mar. 24, 1992

[51] Int. Cl.[5] ..... F21S 1/02

[52] U.S. Cl. ..... 362/147; 362/361

[58] Field of Search ..... 362/351, 361, 147, 354, 362/290, 291; D26/72

[56] References Cited

FOREIGN PATENT DOCUMENTS 366805 2/1932 United Kingdom ..... 362/351

*Primary Examiner*—Ira S. Lazarus
*Assistant Examiner*—L. Heyman
*Attorney, Agent, or Firm*—Varndell Legal Group

[57] ABSTRACT

A wall lamp comprising a conical lamp shade covered with a cover to hold a lamp bulb therein, wherein said lamp shade comprises a plurality of curved slots around a peripheral wall adjacent to a top edge thereof in such length and curvature that light beams from the lamp bulb inside said lamp shade are projected therethrough onto a wall to which said top edge of said lamp shade is secured, to form an image in a spiral pattern.

2 Claims, 5 Drawing Sheets

BACKWARD PROJECTION TYPE WALL LAMP

BACKGROUND OF THE INVENTION

The present invention relates to wall lamps, and more particularly, the present invention relates to a wall lamp which has curved slots on the peripheral wall of the lamp shade thereof for projecting light beams from the lamp bulb therein backwards outwards onto the wall to which said lamp shade is secured.

Because of industrial and economic prosperity, a lamp has no longer a device simply for illumination but also a device for decorative purpose. FIGS. 1 and 2 illustrate a wall lamp according to the prior art which is generally comprised of a lamp shade secured to a flat wall to hold a lamp bulb therein. The lamp shade is comprised of a plurality of acrylic plates surrounding around the lamp bulb therein, and a plurality of wing plates transversely disposed at the bottom to add beauty. Because light from the lamp bulb mainly projects outward in directions parallel to the wall, less attractive lighting effect can be produced.

SUMMARY OF THE INVENTION

The main object of the present invention is to provide a wall lamp which projects light backwards outwards onto the wall to which it is fastened, causing the wall to reflect an image of the predetermined pattern. This object is achieved by making curved slots on the peripheral wall of a lamp shade which is secured to a wall and covered with a cover to hold a lamp bulb therein. The slots are made in such shapes and curvature that the light beams coming from the lamp bulb through the slots will be projected onto the wall to which the lamp shade is secured, and overlapped one another. Therefore, an image in the predetermined pattern is reflected by the wall.

DETAILED DESCRIPTION OF THE PREFERRED EMBODIMENT

Figure 1:
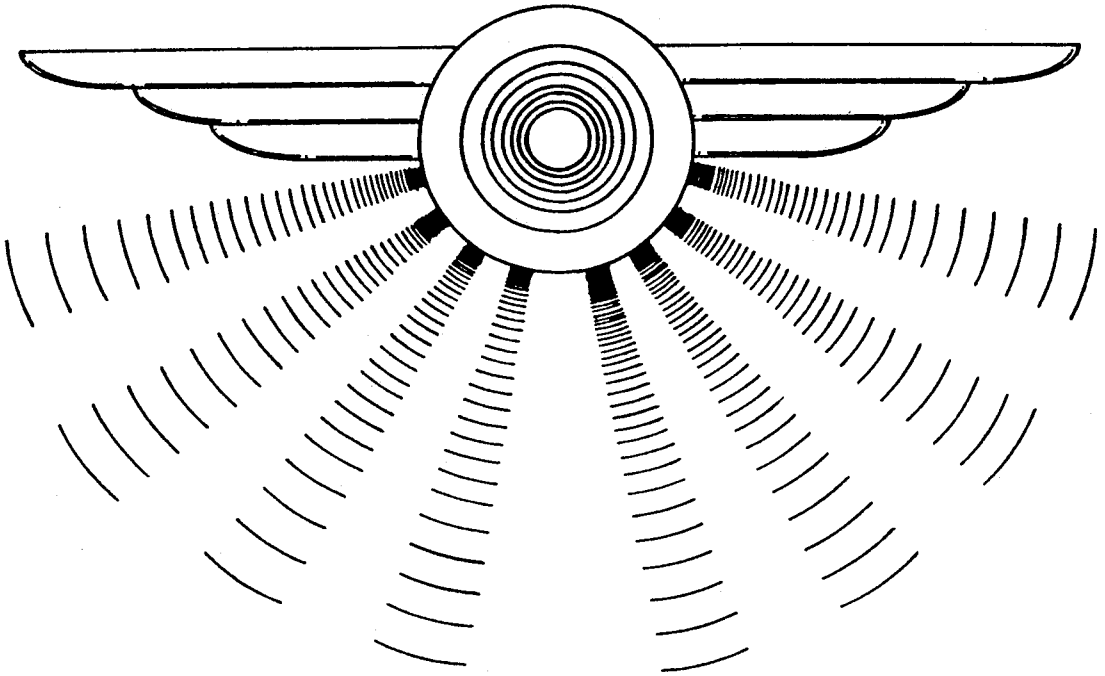
Fig. 1 PRIOR ART
FIG. 1 is a plain front view of a prior art wall lamp.
Figure 2:
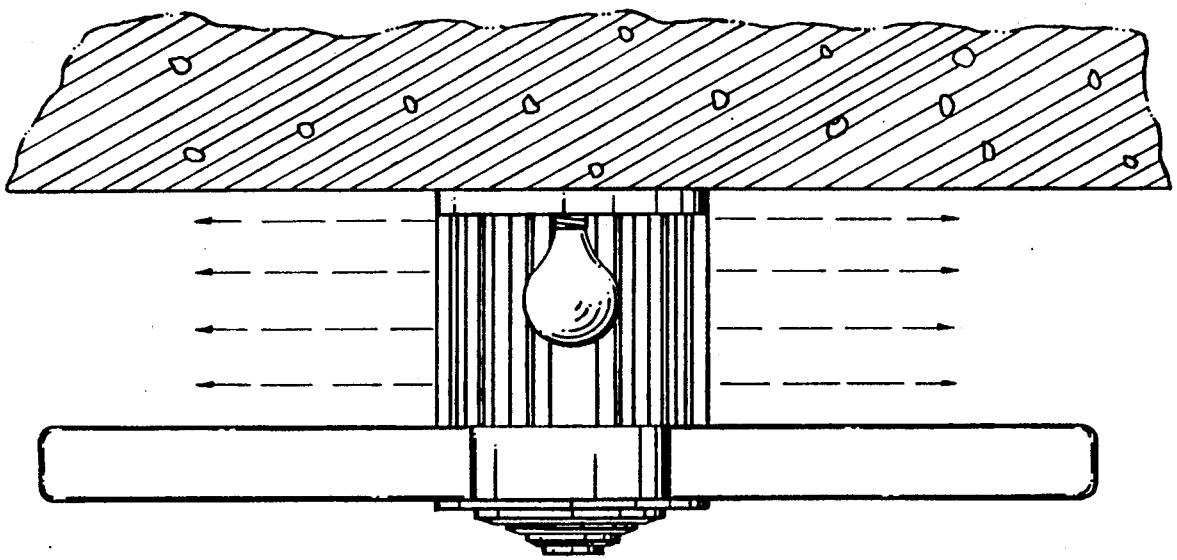
Fig. 2 PRIOR ART
FIG. 2 is a plain side view of the prior art wall lamp of FIG. 1 showing the directions of projected light beams.
Figure 3:
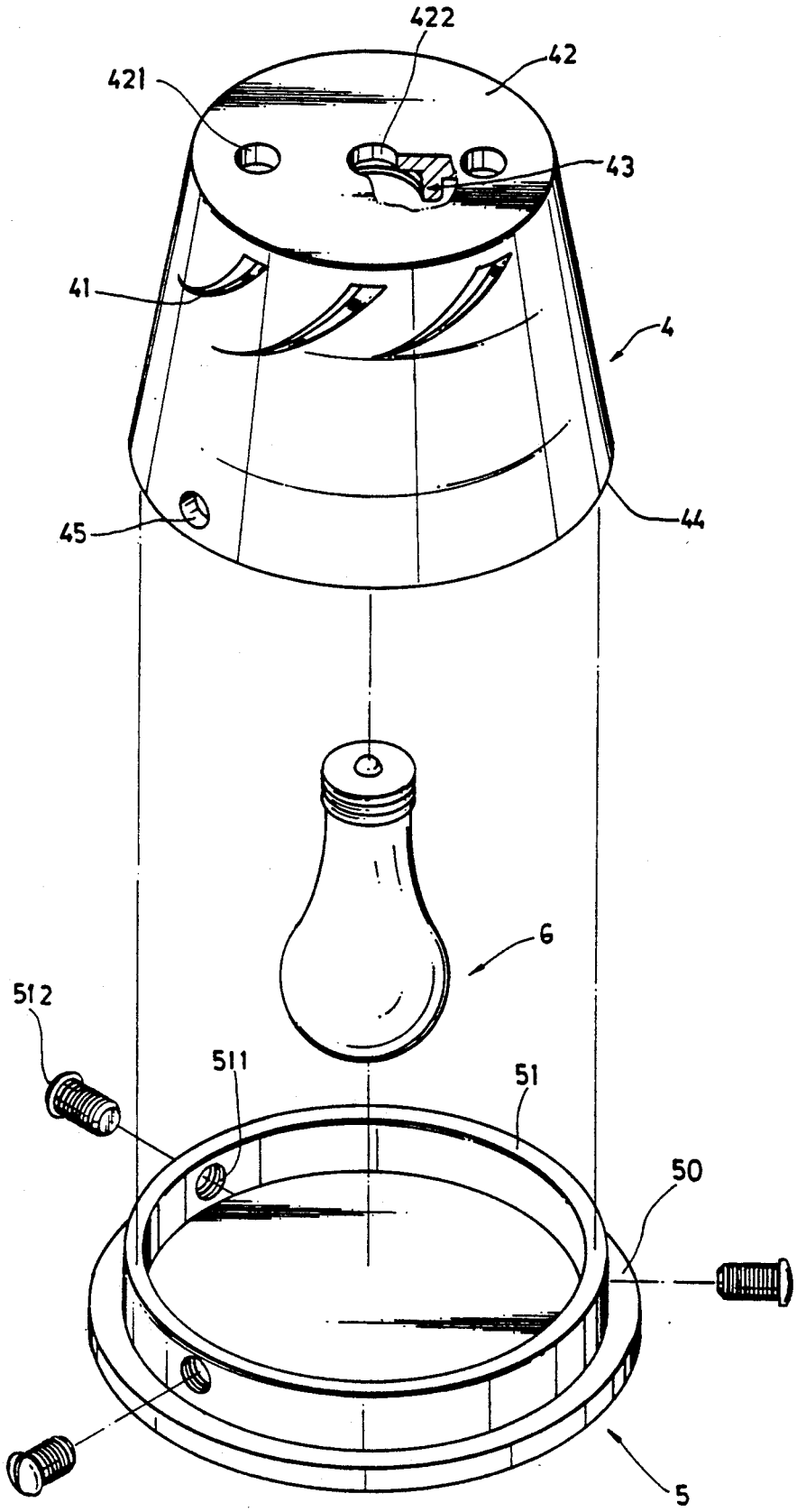
FIG. 3 is an exploded view of the preferred embodiment of the wall lamp of the present invention.

Referring to FIG. 3, a wall lamp as constructed in accordance with the present invention is generally comprised of a lamp shade 4, a cover 5 and a lamp bulb 6. The lamp shade 4 is integrally made in the shape of a conical drum having a plurality of fastening holes 421 and a wire hole 422 on the flat circular top edge 42 thereof, a lamp socket 43 on the internal circular bottom edge thereof for connecting a lamp bulb 6, a plurality of curved saber-like shaped slots as shown at 41 around the peripheral wall thereof adjacent to said top edge 42, and a plurality of through holes 45 around the peripheral wall adjacent to the bottom edge 44 thereof for fastening the cover 5. Through the fastening holes 421, the lamp shade 4 is fastened to a wall or ceiling by fastening elements. The cover 5 may be made from a semi-transparent ceramic material comprising a ring-shaped vertical wall 51 upstanding from a flat, circular bottom 50. The ring-shaped vertical wall 51 comprises a plurality of bolt holes 511 corresponding to the through holes 45 on the peripheral wall of the lamp shade 4. By inserting screws 512 through the through holes 45 into the bolt holes 511 respectively, the cover 5 is secured to the bottom edge 44 of the lamp shade 4.

Figure 4:
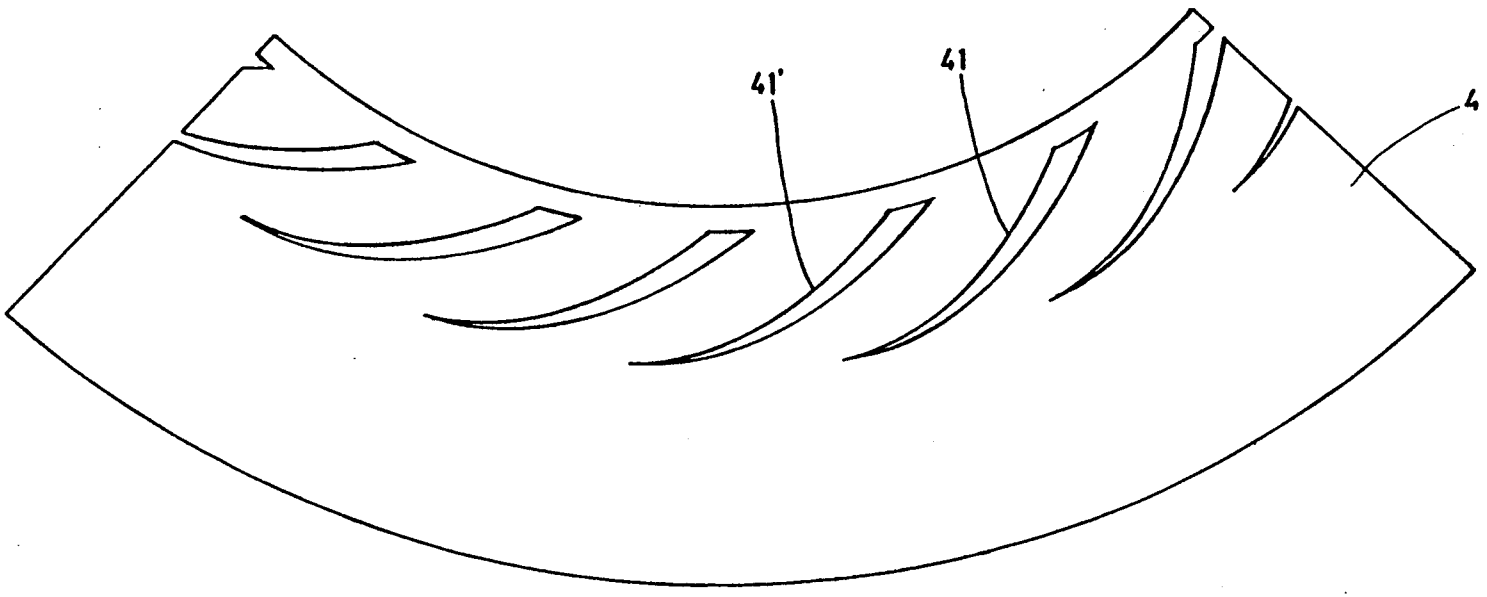
FIG. 4 is a rolled-out view of the peripheral wall of the lamp shade showing the arrangement of the slots thereon.

Referring to FIG. 4, the slots 41 are arranged in a row the length of each slot 41 is approximately one third of the height of the lamp shade 4, and the slots 41 are arranged in the upper half of the peripheral wall of the lamp shade 4. The curvature of each slot 41 is so made that the light beams coming from the lamp bulb 6 through the slots 41 will be projected onto the wall to which the lamp shade 4 is secured, and overlapped one another.

Figure 5:
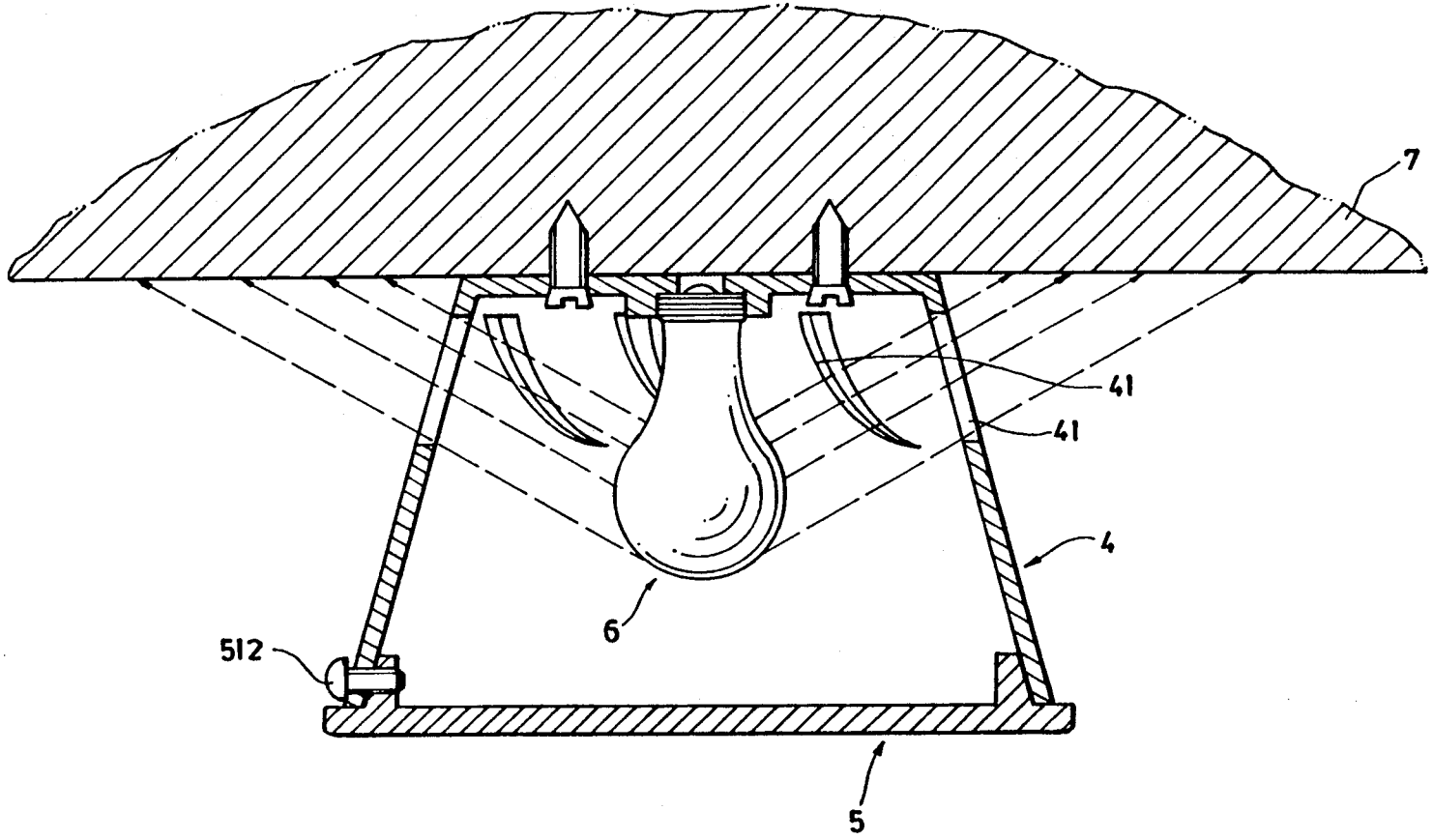
FIG. 5 is a plain side view of the present invention showing the directions of projected light beams from the lamp bulb therein.

Referring to FIG. 5, when the lamp bulb 6 is turned on to give light, a plurality of light beams will be projected through backwards outwards through the slots 41 onto the surface of the wall 7 to which the lamp shade 4 is fastened, and therefore, an image in a spiral pattern will be formed on the surface of the wall. Further, part of light will also be projected downwards through the semi-transparent cover 5. By changing the shape and size of the slots 41 on the lamp shade 4, different pattern of projection can be produced.

I claim:

1. A wall lamp comprising:

a lamp enclosed by a lamp shade and a semi-transparent cover, said lamp shade including a flat circular top edge, a circular bottom edge and a peripheral side wall having a shape of a conical drum integrally formed with said top edge, said cover closing said bottom edge of said lamp shade, said top edge having holes and being directly secured to a flat surface by screws passing through said holes, said peripheral wall having a plurality of slots arranged in a row about its peripheral in a upper half thereof adjacent said top edge, said curved slots having a shape and curvature for projecting a plurality of light beams from said lamp bulb outward and backwards onto said flat surface so that said light beams overlap each other thereon.

2. The wall lamp of claim 2, wherein said curved slots have a length approximately one third of a height of said peripheral wall.

* * * * *